US005349991A

United States Patent [19]

Okawa et al.

[11] Patent Number: 5,349,991

[45] Date of Patent: Sep. 27, 1994

[54] WOVEN SURFACE FASTENER CONSTRUCTION

[75] Inventors: Mitsuhisa Okawa; Ryuichi Murasaki, both of Toyama, Japan

[73] Assignee: Yoshida Kogyo K.K., Tokyo, Japan

[21] Appl. No.: 54,242

[22] Filed: Apr. 30, 1993

[30] Foreign Application Priority Data

May 8, 1992 [JP] Japan ..... 4-037613

[51] Int. Cl.[5] ..... A44B 18/00

[52] U.S. Cl. ..... 139/391; 24/445; 28/161; 428/100

[58] Field of Search ..... 2/DIG. 6, 908, 912, 2/920; 24/442, 443, 445; 139/391, 21, 392, 402–405, 393, 420 A, 50, 51, 908, 912, 920, 419; 28/161; 428/100

[56] References Cited

U.S. PATENT DOCUMENTS

| | | | |
|---|---|---|---|
| 2,717,437 | 10/1952 | Mestral | 28/161 |
| 2,910,096 | 10/1959 | Frey | 139/419 |
| 3,083,737 | 4/1963 | Mestral | 2/DIG 6 X |
| 3,461,513 | 8/1969 | Girard et al. | 24/445 |
| 3,995,105 | 11/1976 | Diesner . | |
| 4,039,008 | 8/1977 | Diesner . | |
| 4,338,800 | 7/1982 | Matsuda | 28/161 X |

FOREIGN PATENT DOCUMENTS

| | | | |
|---|---|---|---|
| 0106771 | 4/1984 | European Pat. Off. . | |
| 3326086 | 8/1984 | Fed. Rep. of Germany . | |
| 3513325 | 10/1986 | Fed. Rep. of Germany | 24/442 |
| 2289651 | 10/1975 | France . | |
| 63-91009 | 6/1988 | Japan . | |

*Primary Examiner*—Andrew M. Falik

*Attorney, Agent, or Firm*—Hill, Steadman & Simpson

[57] ABSTRACT

A surface fastener having a woven tape, wherein said tape includes a number of longitudinal locking regions and a number of longitudinal mesh regions alternately arranged across the width. Each said locking region is woven of weft threads of monofilaments and first and second warp threads, the second warp threads forming male or female engaging elements. Each of the mesh regions includes only the weft threads. Each locking region also includes fixing threads extending along opposite longitudinal edges thereof.

3 Claims, 3 Drawing Sheets

WOVEN SURFACE FASTENER CONSTRUCTION

BACKGROUND OF THE INVENTION

1. Field of the Invention

The present invention relates to a surface fastener with a mesh region formed in the foundation cloth.

2. Description of the Related Art

Conventional surface fasteners with a mesh region formed in the foundation cloth for ventilation and moisture permeability such as disclosed in Japanese Utility Model Laid-Open Publication No. Sho 63-91009 are well known.

The fastener mentioned above for ventilation and moisture permeability is woven only from multifilament threads. This means that when the fastener is sewn it tends to curve along its width. This can be rectified by attempting to uncurl it or by trying to push it down by hand, but this is a very laborious process. Also, the use of multifilament threads means that it takes a long time for it to dry after it has been washed. Additionally, as it is of a woven structure it will tend to drift, which means that the dimensions of its width will not be stable.

SUMMARY OF THE INVENTION

With the foregoing problems in view, it is an object of this invention to provide a surface fastener with which the laborious work formerly involved in the sewing process is removed by stopping the curving of the fastener, which dries quickly after washing and which is stable along its width.

According to this invention, there is provided a surface fastener having a woven tape, wherein said tape includes a number of longitudinal locking regions and a number of longitudinal mesh regions alternately arranged across the width, each of said locking region being woven of weft threads of monofilaments and first and second warp threads, said second warp threads forming male or female engagement elements, each of said mesh regions including only said weft threads, each said locking region also including fixing threads extending along opposite longitudinal edges thereof.

DETAILED DESCRIPTION

The following is a more detailed description of this invention. The surface fastener is made up of male tape which has hooks and female tape which has loops. Although the female tape is shown in FIG. 1, as the male tape is also part of the same structure, the male and female tape will be referred to as tape 1 while the loops or the hooks will be referred to as engagement elements 2.

Figure 1:
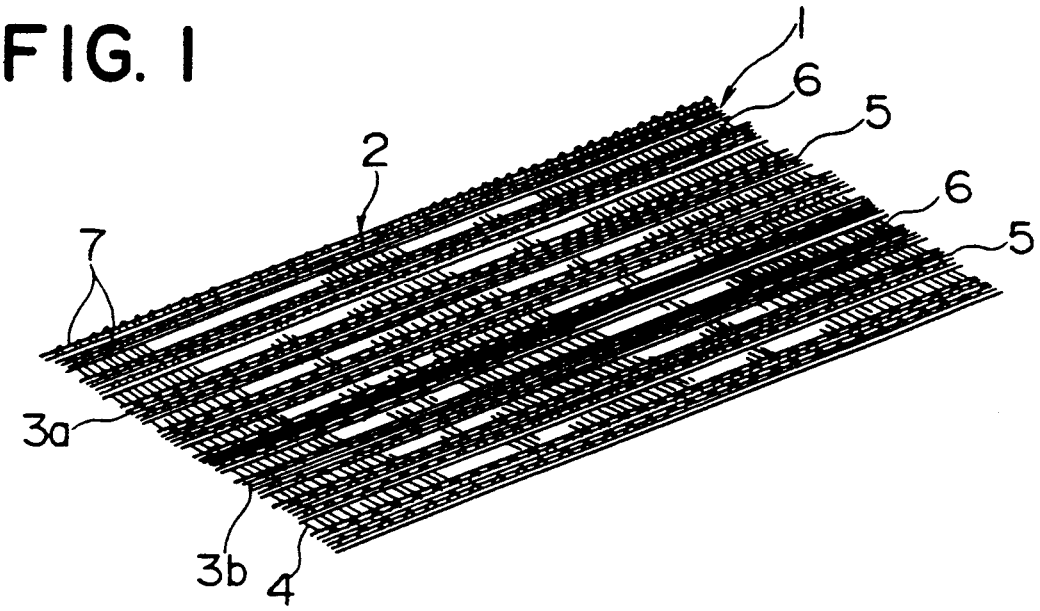
FIG. 1 is an oblique perspective view of one part of the fastener for the present invention.
Figure 3:
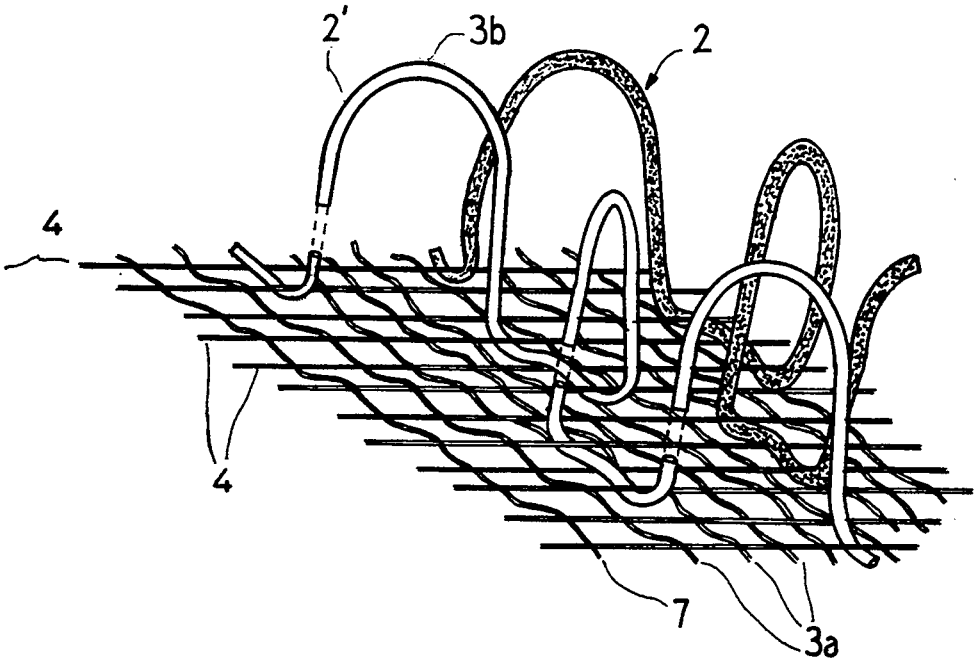
FIG. 3 is a partial perspective view illustrating a hook and loop configuration as an alternative to the loops shown in FIG. 1.

FIG. 3 illustrates at 2', hooks that may be employed in the surface fastener shown in FIG. 1.

The tape 1 is a woven cloth which consists of warp threads 3*a* which make up the foundation cloth, warp threads 3*b* which are made into hooks or loops, and plain woven weft threads 4, and belt shaped locking regions 5 with hooks or loops and mesh regions 6 both of which are disposed alternately along the same direction as the weft thread 4.

Here, warp thread 3*a* may be either a multifilament thread or a monofilament thread but weft thread 4 should be a monofilament thread. It is also preferable if multifilament thread is used as the warp thread 3*b* which forms the loops and monofilament thread is used to form the hooks.

Figure 2:
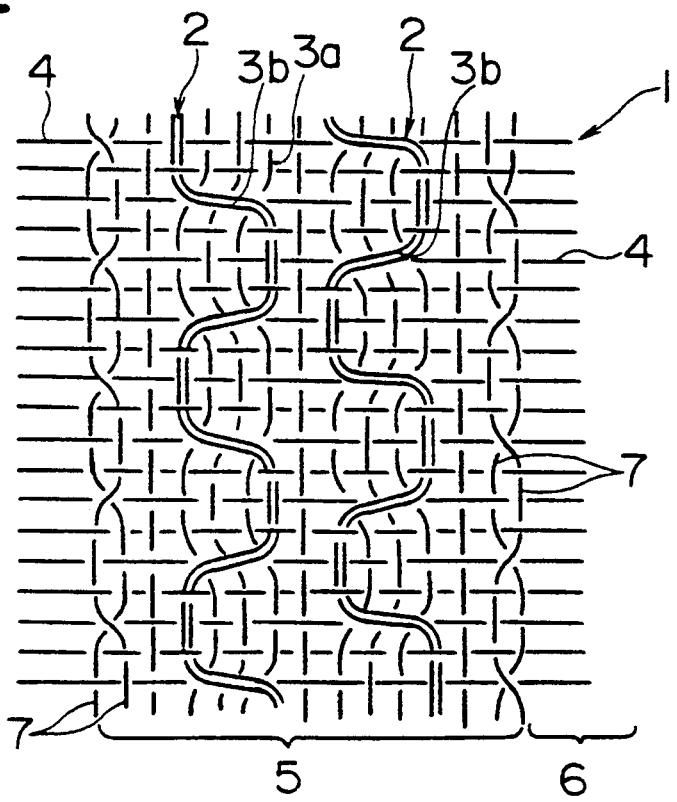
FIG. 2 is a view describing the woven structure of the fastener.

The locking region 5, the structure of which is shown in FIG. 2, consists of warp threads 3*a*, weft threads 4 and engaging elements 2 woven into place and formed by by the warp threads 3*b*. There are also fixing threads 7 running down either side of the locking region 5 in order to keep all the various weft threads in place.

On the other hand, the mesh region 6 consists only of the weft threads 4 with gaps in between them. Also, although this is not shown in the diagrams, a layer of resin coating is applied to the surface of the tape 1 but should be applied in such a way so as not to close the gaps between the weft threads 4. A gap of between 0.01 mm and 10 mm would be suitable but this would however depend on the viscosity of the resin coating. A gap greater than this would be detrimental to the rigidity of the tape 1. A hook shape has been used as the shape of the engaging element for the purposes of describing this invention but a mushroom shaped element would also be suitable.

Figure 4:
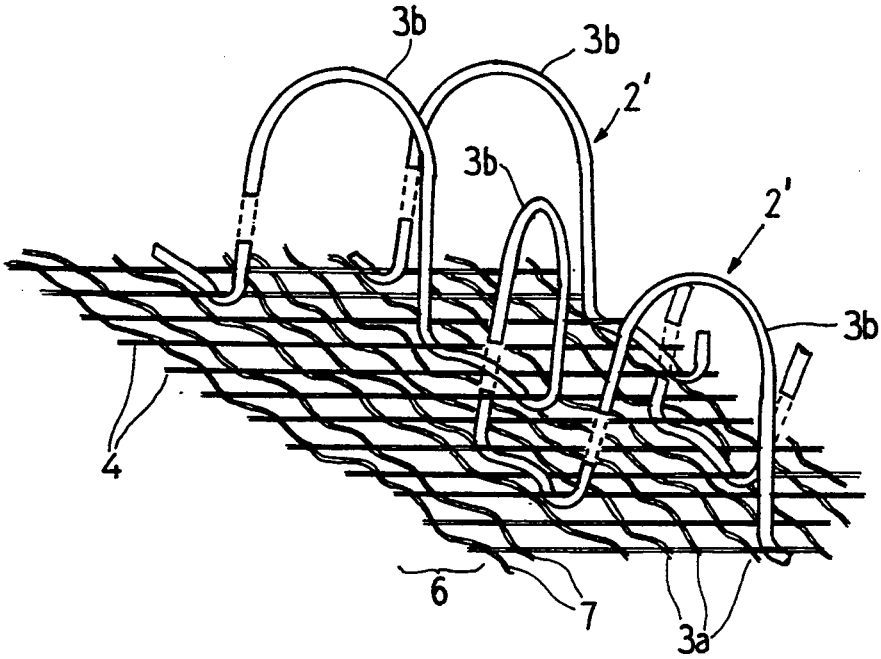
FIG. 4 is a partial perspective view of a hook configuration as an alternative to the loops shown in FIG. 1.
Figure 5:
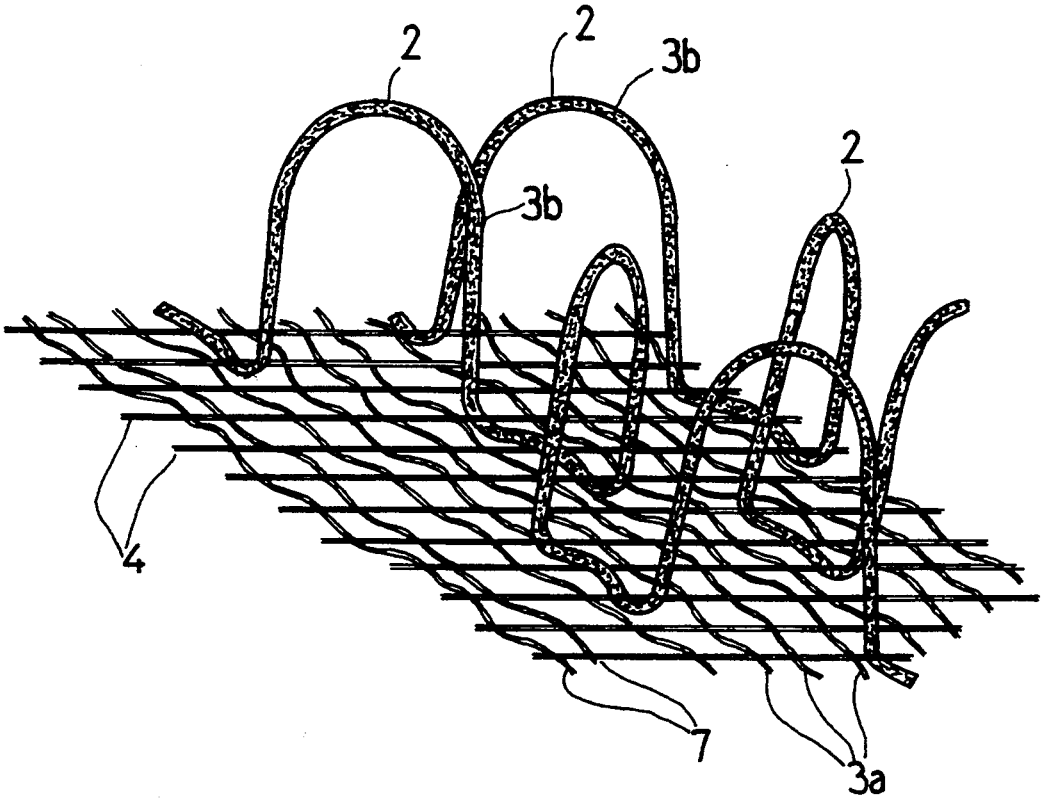
FIG. 5 is a partial perspective view of the loop configuration of FIG. 1 and FIG. 2.

FIG. 3 illustrates the hooks 2' which are formed from split loops as is known, along with loops 2. FIG. 4 illustrates a hook region with hooks 2' only and FIG. 5 shows a loop region with only loops 2.

The surface fastener in this invention consists of a woven tape which has locking regions which can be alternately either male or female formed from monofilament warp threads along the direction of the weft thread, a mesh region made up only of weft threads and fixing threads running down both sides of the locking region. Having this kind of construction ensures that any ventilation and moisture permeability work efficiently, stops the tendency of the tape to curve up during the sewing process and greatly reduces the drying time after washing.

As the locking portion has fixing threads running down both of its sides, it will keep its shape well.

What is claimed is:

1. A surface fastener having a woven tape forming a tape surface, wherein said tape includes a number of longitudinal locking regions and a number of longitudinal mesh regions alternately arranged across the width, each said locking region being woven of weft threads of monofilaments and first and second warp threads, the second warp threads forming male or female engaging elements extending outwardly from a plane parallel to the tape surface, each of said mesh regions including only the weft threads.

2. A surface fastener having a woven tape, wherein said tape includes a number of longitudinal locking regions and a number of longitudinal mesh regions alternately arranged across the width, each of said locking region being woven of weft threads of monofilaments and first and second warp threads, said second warp threads forming male or female engaging elements, each of said mesh regions including only the weft threads; and wherein each said locking region also includes fixing threads extending along opposite longitudinal edges thereof.

3. A surface fastener having a woven tape according to claim 1, wherein each said locking region also includes fixing threads extending along opposite longitudinal edges thereof.

* * * * *